US005746182A

United States Patent [19]

Nada

[11] Patent Number: 5,746,182

[45] Date of Patent: May 5, 1998

[54] METHOD OF CONTROLLING FUEL INJECTION IN ENGINES

[75] Inventor: Mitsuhiro Nada, Toyota, Japan

[73] Assignee: Toyota Jidosha Kabushiki Kaisha, Toyota, Japan

[21] Appl. No.: 816,331

[22] Filed: Mar. 13, 1997

[30] Foreign Application Priority Data

Mar. 19, 1996 [JP] Japan ..... 8-062899

[51] Int. Cl.[6] ..... F02M 51/00

[52] U.S. Cl. ..... 123/492

[58] Field of Search ..... 123/492, 493, 123/478, 489, 480

[56] References Cited

U.S. PATENT DOCUMENTS

| | | | |
|---|---|---|---|
| 4,633,841 | 1/1987 | Matsura et al. | 123/492 |
| 5,546,909 | 8/1996 | Messih et al. | 123/492 |
| 5,584,277 | 12/1996 | Chen et al. | 123/480 |
| 5,611,315 | 3/1997 | Dohta et al. | 123/492 |

FOREIGN PATENT DOCUMENTS

| | | | |
|---|---|---|---|
| A-60-233352 | 11/1985 | Japan | 123/492 |
| A-6-117298 | 4/1994 | Japan | 123/492 |
| A-6-185397 | 7/1994 | Japan | 123/492 |
| A-6-330788 | 11/1994 | Japan | 123/492 |
| A-7-103025 | 4/1995 | Japan | 123/492 |

*Primary Examiner*—Raymond A. Nelli
*Attorney, Agent, or Firm*—Oliff & Berridge, PLC

[57] ABSTRACT

A fuel injection control method for an engine. Each cylinder accommodates a piston that reciprocates in accordance with rotation of a crankshaft. Each piston performs a suction stroke in accordance with the position of the crankshaft. The intake passage draws air into the cylinders. The throttle valve adjusts a passage area of the intake passage. The throttle valve may suddenly increase the passage area during engine acceleration. The fuel injection valve is provided in association with each of the cylinders to inject fuel for the associated cylinder. The method includes performing sequential injection by injecting fuel in accordance with the position of the crankshaft, performing non-sequential injection in a manner unrelated to the position of the crankshaft in addition to sequential injection when the throttle valve suddenly increases the passage area of the intake passage, which increases the flow rate of intake air, so as to compensate for the increased flow rate of intake air, determining whether the present flow rate of intake air for a selected cylinder will increase, and prohibiting non-sequential injection when it is determined that the flow rate of intake air for the selected cylinder will not further increase.

12 Claims, 6 Drawing Sheets

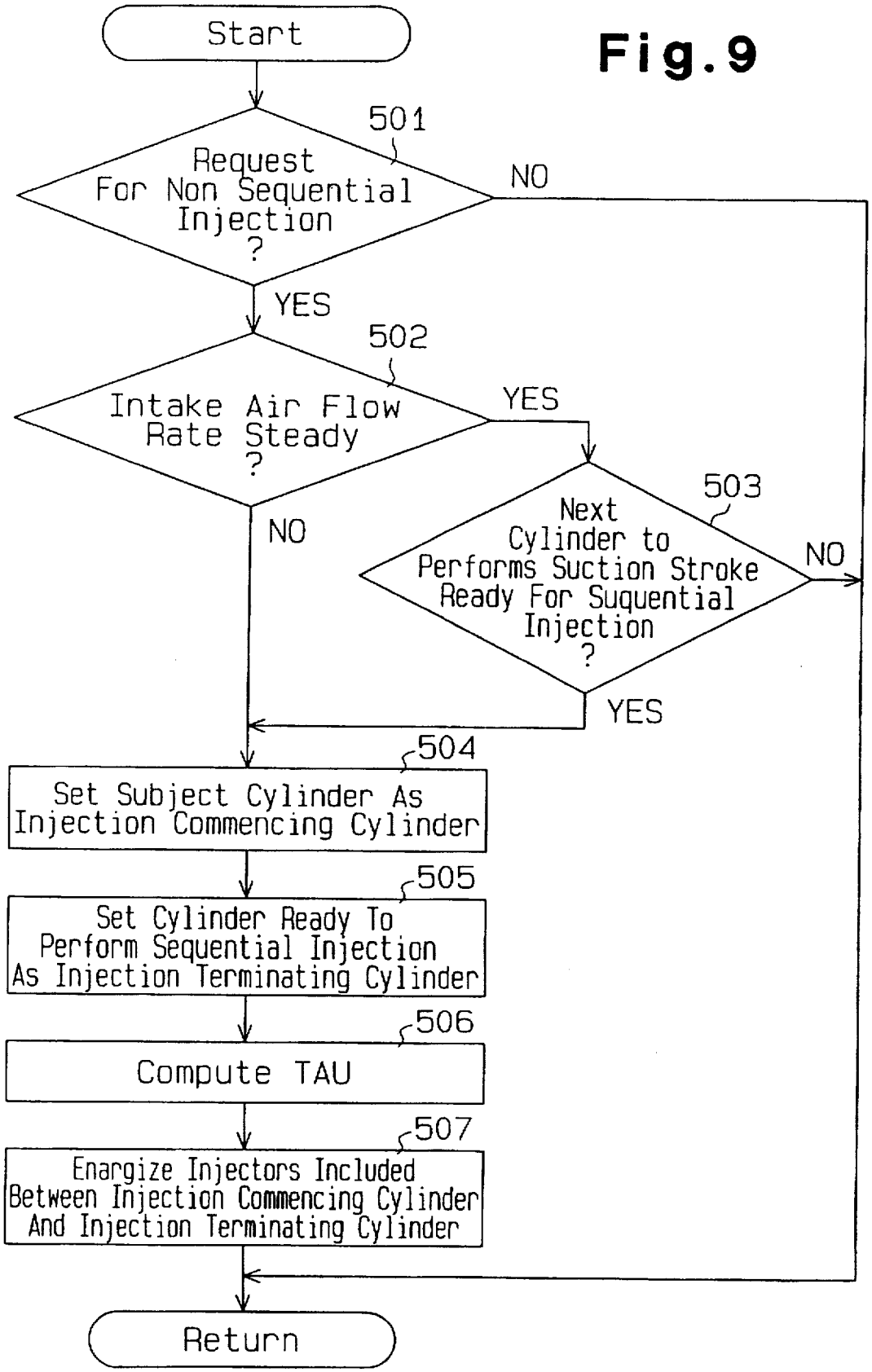
Start
Fig.9
501
Request For Non Sequential Injection ?
NO
YES
502
Intake Air Flow Rate Steady ?
YES
NO
503
Next Cylinder to Performs Suction Stroke Ready For Suquential Injection ?
NO
YES
504
Set Subject Cylinder As Injection Commencing Cylinder
505
Set Cylinder Ready To Perform Sequential Injection As Injection Terminating Cylinder
506
Compute TAU
507
Enargize Injectors Included Between Injection Commencing Cylinder And Injection Terminating Cylinder
Return

METHOD OF CONTROLLING FUEL INJECTION IN ENGINES

BACKGROUND OF THE INVENTION

1. Field of the Invention

The present invention relates to a method for controlling fuel injection valves that are provided for each cylinder of an engine. More particularly, the present invention pertains to a method for controlling sequential injection, in which fuel injection from the injection valves is performed in relation to the position of the crankshaft, and for controlling non-sequential injection, in which fuel injection is performed in a manner unrelated to the position of the crankshaft.

2. Description of the Related Art

Microcomputers are widely used in engines to control the timing at which fuel is injected from injection valves, one of which is provided for each cylinder. There are various ways to control the timing of fuel injection. For example, sequential injection is performed to control fuel injection from the injection valves in accordance with the position of the crankshaft.

To perform sequential injection, it is required that the amount of fuel injection be computed based on the amount of intake air that is present. It is also required that the computed fuel injection amount be injected before each cylinder enters the suction stroke. If fuel is injected during the suction stroke, it is difficult to achieve a stoichiometric air-fuel ratio. Thus, in sequential injection, the fuel injection amount is determined under the presumption that the current air flow rate is the same as the flow rate during the actual suction stroke. Therefore, when the opening of the throttle valve is suddenly widened during acceleration or similar situations, the actual air flow rate is higher than the presumed air flow rate. This results in the amount of fuel being insufficient with respect to the amount of intake air, that is, it causes a lean air-fuel ratio. When the air-fuel mixture is lean, the engine torque is relatively weak regardless of the widened throttle opening, which degrades performance.

To cope with this problem, Japanese Unexamined Patent Publication 7-103025 describes an engine that performs non-sequential injection (simultaneous injection) in addition to sequential injection. During engine speed acceleration, non-sequential injection is performed to control fuel injection in a manner unrelated to the position of the crankshaft. Fuel is injected toward each cylinder simultaneously to increase the amount of fuel to thus compensate for the increased amount of air.

However, when performing non-sequential or simultaneous injection, the injection results in fuel being injected toward every cylinder including those that do not require an increase in the amount of fuel. That is, some cylinders can cope with the increase in the amount of intake air through sequential injection and need not undergo non-sequential injection. Although non-sequential injection improves performance, it also produces undesirable emissions.

SUMMARY OF THE INVENTION

Accordingly, it is an objective of the present invention to improve performance while also preventing undesirable emissions in an engine, which performs both sequential injection and non-sequential injection.

To achieve the above objective, the present invention provides a fuel injection control method for an engine. The engine has a plurality of cylinders, an intake passage, a throttle valve, and a fuel injection valve. Each cylinder accommodates a piston that reciprocates in accordance with rotation of a crankshaft. Each piston performs a suction stroke in accordance with the position of the crankshaft. The intake passage draws air into the cylinders. The throttle valve adjusts a passage area of the intake passage. The throttle valve may suddenly increase the passage area during engine acceleration. The fuel injection valve is provided in association with each of the cylinders to inject fuel for the associated cylinder. The method includes performing sequential injection by injecting fuel in accordance with the position of the crankshaft, performing non-sequential injection in a manner unrelated to the position of the crankshaft in addition to sequential injection when the throttle valve suddenly increases the passage area of the intake passage, which increases the flow rate of intake, so as to compensate for the increased flow rate of intake air, determining whether the present flow rate of intake air for a selected cylinder will increase, and prohibiting non-sequential injection when it is determined that the flow rate of intake air for the selected cylinder will not further increase.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 9 is a flowchart showing a routine for selecting a cylinder that requires non-sequential injection and performing injection for the selected cylinder.

DETAILED DESCRIPTION OF THE PREFERRED EMBODIMENT

A fuel injection controlling method according to an embodiment of the present invention will hereafter be described with reference to the drawings.

Figure 1:
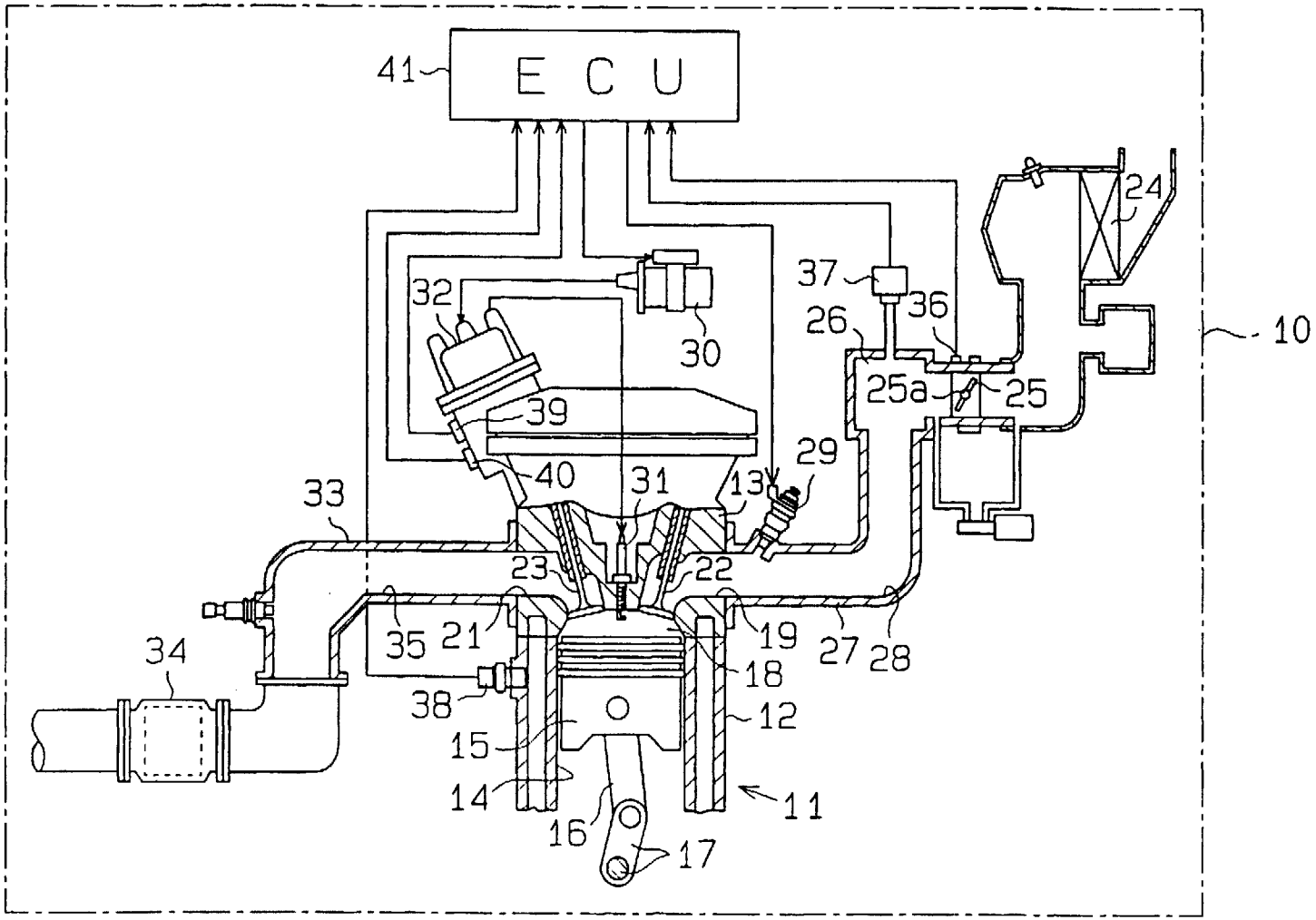
FIG. 1 is a schematic drawing showing an engine to which a fuel injection controlling method according to the present invention is applied.

As shown in FIG. 1, a gasoline engine 11 is installed in a vehicle 10. The engine 11 includes a cylinder block 12 and a cylinder head 13. The cylinder block 12 is provided with a plurality of cylinder bores 14. A piston 15 is reciprocally accommodated in each cylinder bore 14. Each piston 15 is connected to a crankshaft 17 by a connecting rod 16. The connecting rod 16 converts reciprocating movement of each piston 15 to rotating movement of the crankshaft 17. A combustion chamber 18 is defined between the cylinder block 12 and the cylinder head 13 above each piston 15. Each combustion chamber 18 is communicated with an intake port 19 and an exhaust port 21. The intake port 19 is selectively opened and closed by an intake valve 22. The exhaust port 21 is selectively opened and closed by an exhaust valve 23.

Each intake port 19 is connected to an intake passage 28, which extends through an air cleaner 24, a throttle valve 25, a surge tank 26, an intake manifold 27, and other parts. The ambient air drawn into the engine 11 passes through the air cleaner 24, the throttle valve 25, the surge tank 26, and the intake manifold 27 and is sent into the combustion chamber 18.

The throttle valve 25 is rotatably supported by a shaft 25*a* that is provided in the intake passage 28. A cable or the like connects the shaft 25*a* to an acceleration pedal (not shown) provided in front of a driver's seat. The flow rate of the air flowing through the intake passage 28 is determined by the opening area of the air flow path. The opening area of the air flow path is adjusted by the throttle valve 25.

An injector 29 serving as a fuel injection valve is provided for each combustion chamber 18 in the intake manifold 27. The injectors 29 are electromagnetic valves. When energized, each injector 29 injects fuel toward the associated intake port 19. The mixture of the intake air and the fuel injected from each injector 29 is drawn into the associated combustion chamber 18. The mixture is ignited by an ignition plug 31, one of which is provided in the cylinder head 13 for each combustion chamber 18.

The cylinder head 13 is provided with a distributor 32. A rotor is incorporated in the distributor 32. The rotor is rotated once for every two rotations of the crankshaft 17. The rotation of the rotor causes the distributor 32 to produce high voltage. High voltage is output from an ignitor 30 and distributed to each ignition plug 31 by the distributor 32 in accordance with the rotational angle of the crankshaft, or crank angle (°CA). This causes each ignition plug 31 to ignite and burn the air-fuel mixture in the associated combustion chamber 18 at the appropriate time. The combustion of the mixture produces hot and highly pressurized gas that forces the piston 15 downward. This rotates the crankshaft 17 and generates engine power.

Each exhaust port 21 is connected to an exhaust passage 35 which extends through an exhaust manifold 33, a catalytic converter 34, and through other parts. The burned gas produced in the combustion chamber 18 passes through the exhaust manifold 33 and the catalytic converter 34 to be discharged from the engine 11.

In the engine 11, air-fuel mixture is drawn into the combustion chamber 18, and exhaust gases are discharged therefrom as the piston 15 undergoes two reciprocations, or four strokes to complete one cycle. During a single cycle, the crankshaft 17 completes two rotations. Each cycle consists of the intake stroke, the compression stroke, the combustion and expansion stroke, and the exhaust stroke. During the intake stroke, the downward movement of the piston 15 produces negative pressure in the combustion chamber 18 and draws air-fuel mixture into the chamber 18. In the compression stroke, the upward movement of the piston 15 compresses the air-fuel mixture. In the combustion and expansion stroke, the piston 15 is moved downward by the ignition and combustion of the compressed air-fuel mixture. In the exhaust stroke, the piston 15 is moved upward again so as to exhaust the burned gases from the combustion chamber 18. The four cylinders (first, second, third, and fourth) of the engine 11 are aligned in sequential order. However, cycles are initiated in the order of the first, third, fourth, and second cylinder. After the crankshaft 17 rotates 180° CA, a new cycle starts in the subsequent cylinder.

Figure 8:
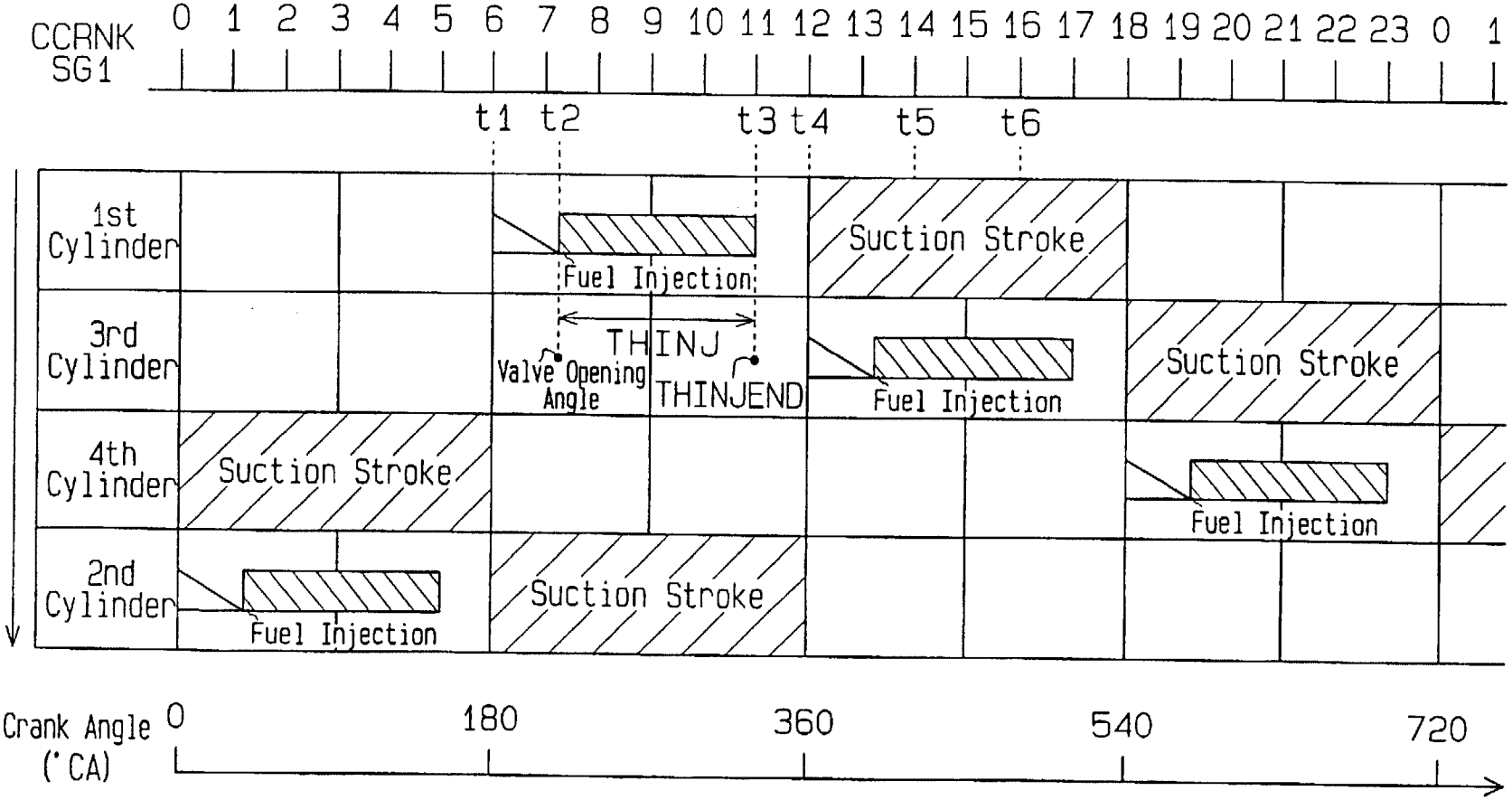
FIG. 8 is a time chart showing the timing of sequential fuel injection.

The engine 11 is provided with a throttle position sensor 36, an intake air pressure sensor 37, an engine speed sensor 39, and a cylinder distinguishing sensor 40. The throttle position sensor 36 is arranged in the vicinity of the throttle valve 25 in the intake passage 28 to detect the rotational angle of a throttle valve shaft 25*a*, or the throttle opening amount TA. The intake air sensor 37 is arranged in the surge tank 26 to detect the pressure therein, or the intake air pressure PM. The coolant temperature sensor 38 is arranged in the cylinder block 12 to detect the temperature of the coolant flowing through a water jacket of the engine 11, or the coolant temperature THW. The engine speed sensor 39 is arranged in the distributor 32 to output a crank angle signal SG1 every time the crankshaft 17 rotates a predetermined angle (e.g., 30° CA), as shown in FIG. 8. The cylinder distinguishing sensor 40 is arranged in the distributor 32 to output a cylinder distinguishing signal SG2 every time the crankshaft 17 rotates 360° CA.

Figures 2, 3:
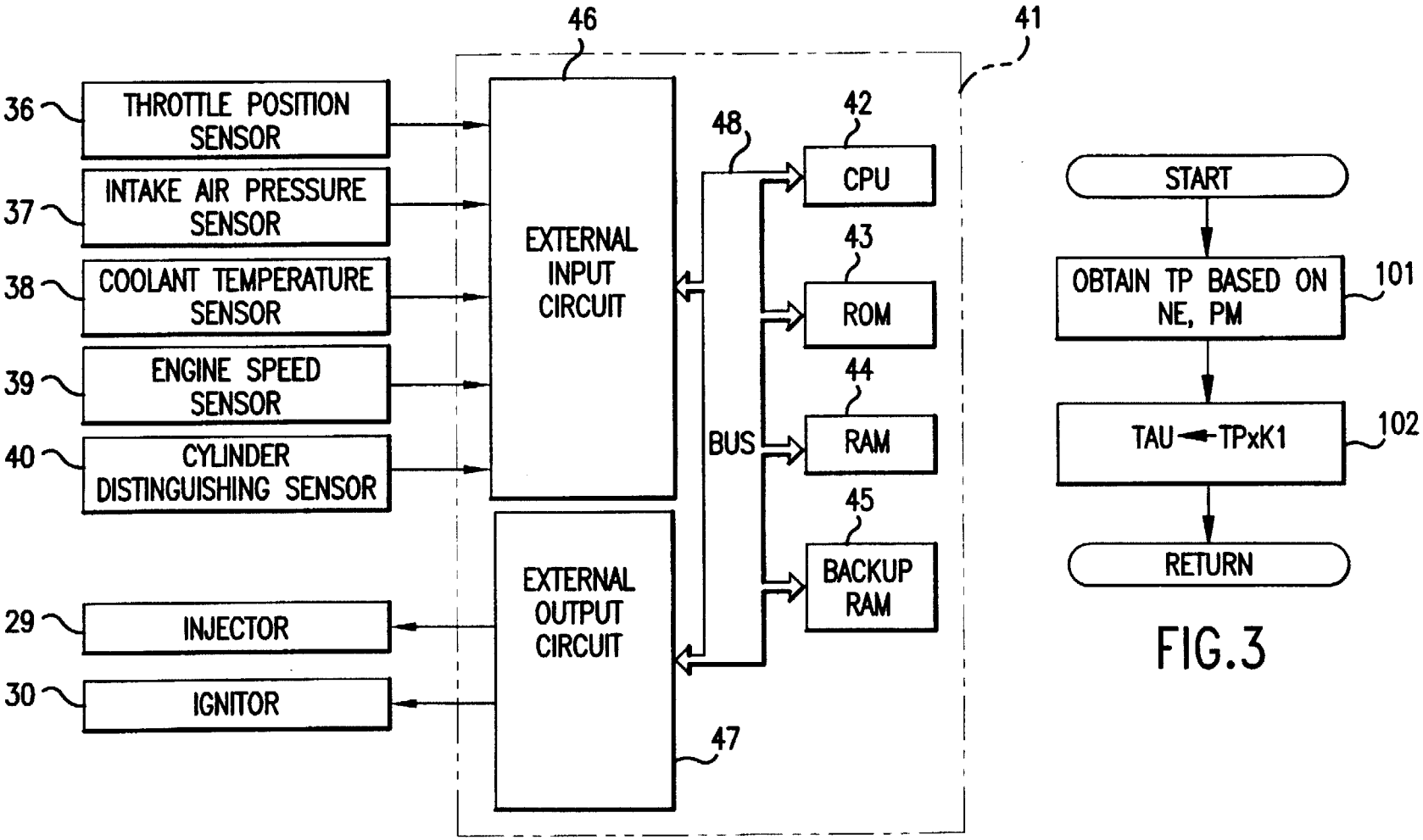
FIG. 2 is a block drawing showing the electrical structure of an electronic control unit.
FIG. 3 is a flowchart showing a routine executed to compute the length of injection time.

As shown in FIG. 1, an electronic control unit (ECU) 41 is installed to control the injectors 29, the ignitors 30, and other parts. As shown in FIG. 2, the ECU 41 includes a central processing unit (CPU) 42, a read only memory (ROM) 43, a random access memory (RAM) 44, a backup RAM 45, an external input circuit 46, and an external output circuit 47. The CPU 42, the ROM 43, the RAM 44, the backup RAM 45, the external input circuit 46, and the external output circuit 47 are connected to each other by a bus 48. Predetermined control programs and initial data are stored in the ROM 43. For example, the ROM 43 stores programs used during sequential injection (FIGS. 3 to 7) and programs used during non-sequential injection.

The CPU 42 carries out various computations in accordance with the control programs and data stored in the ROM 43. The RAM 44 temporarily stores the computation results obtained by the CPU 42. The backup RAM 45 stores the data in the RAM 44 even when the ECU 41 is deactivated.

The throttle position sensor 36, the intake air pressure sensor 37, the coolant temperature sensor 38, the engine speed sensor 39, and the cylinder distinguishing sensor 40 are each connected to the external input circuit 46. The injectors 29 and the ignitors 30 are each connected to the external output circuit 47.

The detecting signals from the sensors 36–40 are input to the CPU 42 by way of the external input circuit 46. The CPU 42 carries out various computations based on the data sent from the sensors 36–40 to operate the injectors 29 and the ignitors 30 and controls fuel injection and ignition timing.

The CPU 42 computes the engine speed NE, which corresponds to the number of rotations of the crankshaft 17 per unit time by measuring the length of time during which the crank angle signal SG1 is output by the speed sensor 39.

To control the ignition timing, data related to the optimum ignition timing with respect to the operating state of the engine 11 is stored in the ROM 43. From the detecting signals sent through the external input circuit 46, the CPU 42 detects the operating state of the engine 11, that is, conditions such as the engine speed NE, the intake air pressure PM, and whether the engine 11 is warmed up. The CPU 42 then refers to the data stored in the ROM 43 to compute the optimum ignition timing and sends a primary current interrupting signal to the ignitor 30 to control the ignition timing.

Figure 4:
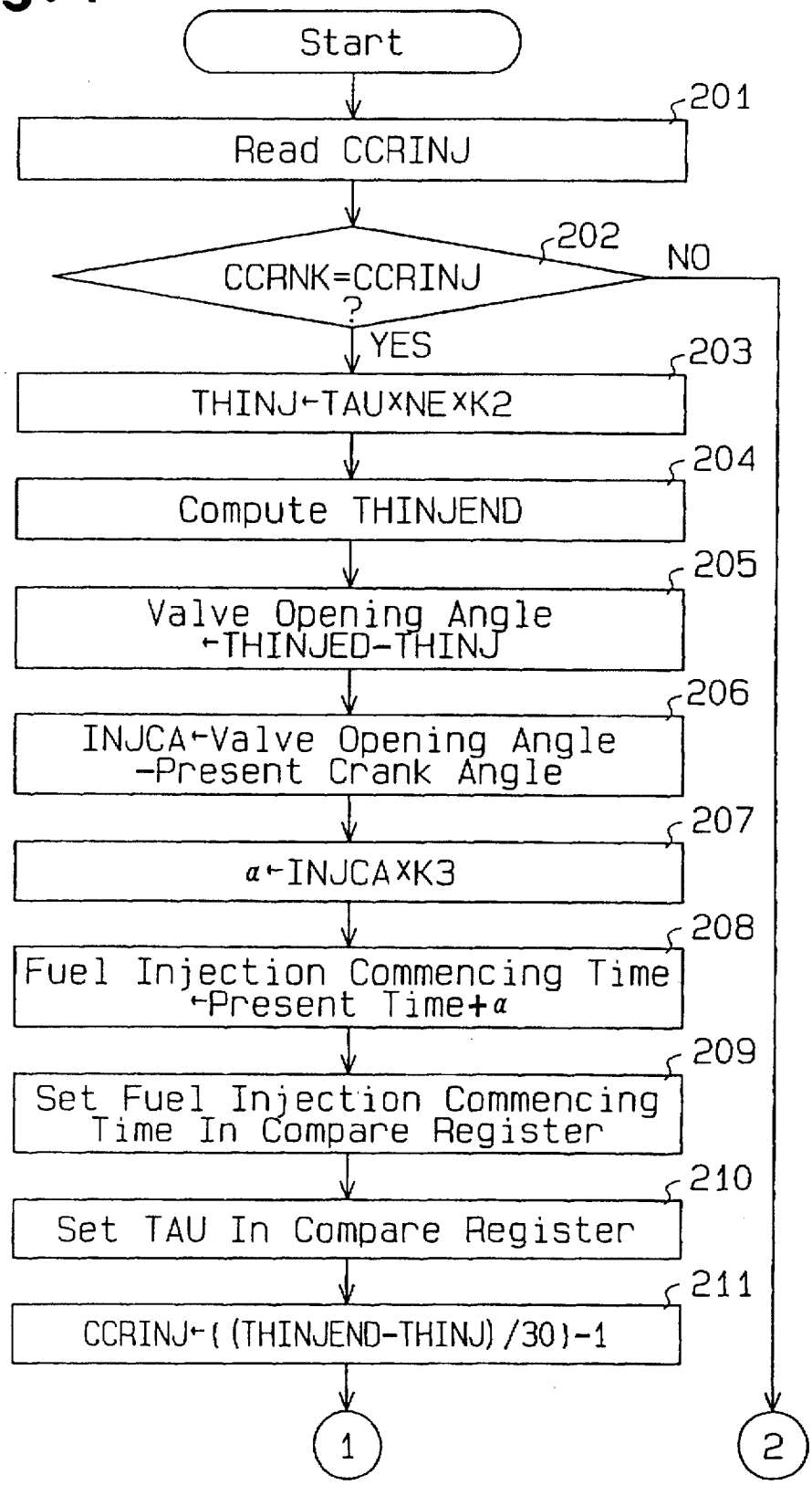
FIG. 4 is a flowchart showing a routine for setting the injection commencing time and for obtaining the initial timing for processing injection in the subsequent cylinder.
Figure 5:
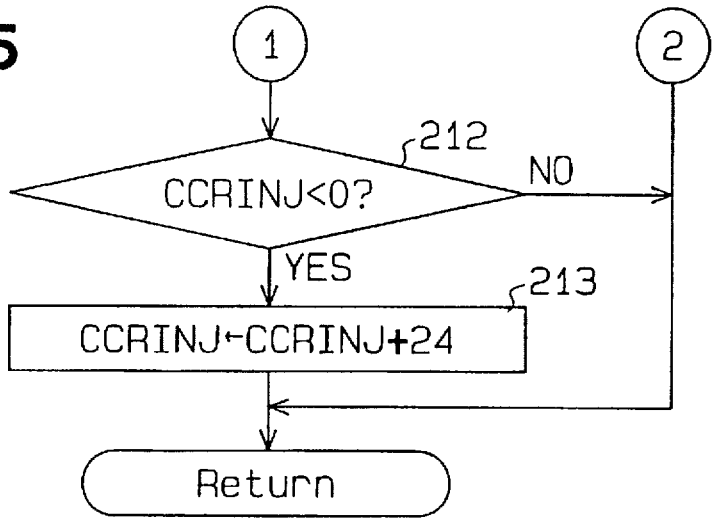
FIG. 5 is a flowchart showing a routine for setting the injection commencing time and for obtaining the initiating timing for fuel injection in the subsequent cylinder.
Figure 6:
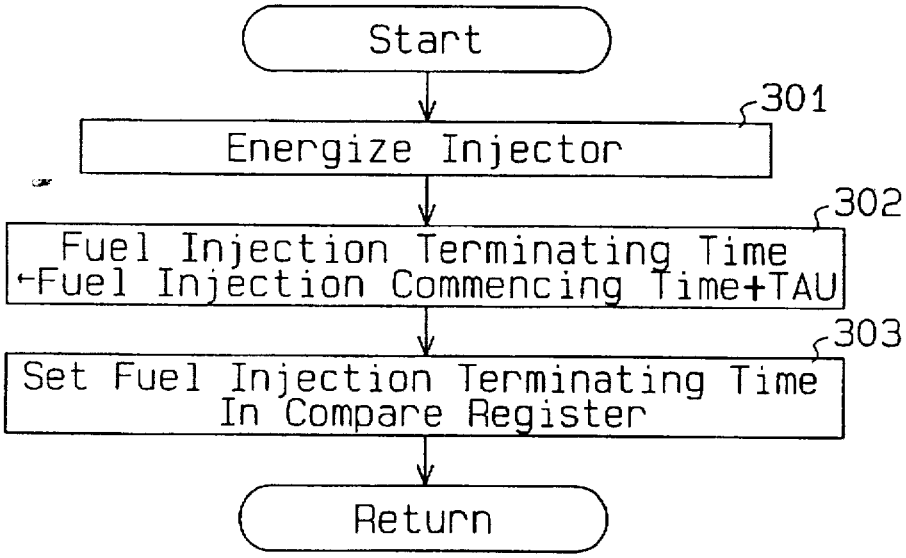
FIG. 6 is a flowchart showing a routine for performing fuel injection.
Figure 7:
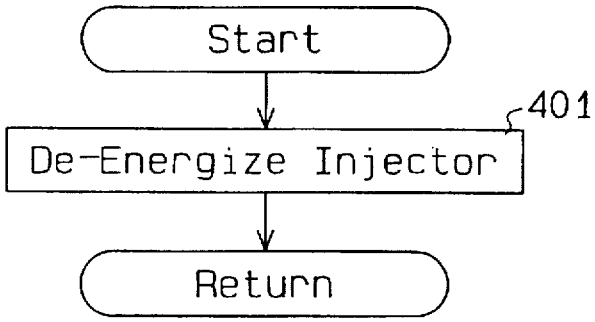
FIG. 7 is a flowchart showing a routine for stopping fuel injection.

The processing executed by the CPU 42 to perform sequential injection will now be described. A flowchart shown in FIG. 3 illustrates a routine for computing the injection time length TAU. A further flowchart shown in FIGS. 4 and 5 illustrates a routine for setting an injection commencing time and for obtaining the timing for initiating injection control processing for the following cylinder at which injection is to be performed. In FIGS. 6 and 7, flowcharts illustrate routines for executing and terminating fuel injection.

In the routine of FIG. 3, the flow rate, or quantity, of intake air that is drawn into combustion chamber 18 after passing through the intake passage 28 is obtained from the throttle opening amount TA and the engine speed NE. The mass of the fuel burned with the intake air, or the amount of fuel injected for the combustion chamber 18 is also obtained. The fuel injection amount is determined by the injection time length during which the fuel is injected through a needle valve (not shown) provided in each injector 29. In other words, the fuel injection amount is determined by the excited time length of a solenoid coil (not shown) that is used to operate the needle valve. To compute the fuel injection amount, the CPU 42 computes the injection time length TAU.

In step 101, the CPU 42 reads the engine speed NE and the intake air pressure PM. The CPU 42 then refers to a map to obtain a basic injection time length TP that corresponds to the detected engine speed NE and intake air pressure PM.

In step 102, the CPU 42 computes the injection time length TAU from the following equation (1). After the computation, the CPU 42 ends the routine.

$$TAU=TP\times K1 \quad (1)$$

In this equation, K1 represents a compensation coefficient. The coefficient is obtained from coefficients that are related to feedback control of the intake air temperature, warming up of the engine, starting of the engine, engine power, air-fuel ratio, and other factors.

The routine shown in FIG. 4 is initiated each time the crankshaft 17 rotates 30°. A 30° rotation of the crankshaft 17 adds a value of one to the crank count CCRNK. As shown in FIG. 8, the crank count CCRNK corresponds to the counted number of the crank angle signals SG1 sent from the speed sensor 39. The counted values of "0" to "23" are stored in sequential order. The crank count CCRNK is reset for every two cylinder distinguishing signals SG2 that are input to the ECU 41.

When entering the routine illustrated in FIG. 4, in step 201, the CPU 42 reads an initiating timing CCRINJ for fuel injection, which was stored during the previous control cycle. The initiating timing CCRINJ determines the timing to initiate fuel injection in the following cylinder and is an integer from "0" to "23". In step 202, the CPU 42 judges whether the value of the crank count CCRNK matches the value of the initiating timing CCRINJ. If this condition is not satisfied, the CPU 42 ends the routine. When this condition is satisfied, the CPU 42 proceeds to step 203 and computes a valve open time length angle THINJ that indicates the rotated crankshaft angle during which fuel is injected from the associated injector 29 through the following equation.

$$THINJ=TAU\times NE\times K2 \quad (2)$$

In this equation, K2 represents a coefficient for converting the injection time length TAU to an angle.

In step 204, the CPU 42 obtains a valve closing angle THINJEND that indicates the crankshaft angle at which fuel injection from the injector 29 is terminated based on the intake air pressure PM, the engine speed NE, and other factors. In step 205, the CPU 42 subtracts the time length angle THINJ from the valve closing angle THINJEND to obtain a valve opening angle that indicates the crankshaft angle at which the injector 29 commences fuel injection. In step 206, the CPU 42 subtracts the present crank angle from the valve opening angle to obtain an angle INJCA that indicates the change in the crank angle during the period starting from when the routine is started until when the injection of fuel is commenced by the injector 29.

In step 207, the CPU 42 computes a time length α from the following equation (3). The time length α indicates the period from when the routine is initiated to when the fuel injection is commenced.

$$\alpha=INJCA\times K3 \quad (3)$$

In this equation, K3 represents a coefficient for converting an angle into time.

In step 208, the CPU 42 obtains the fuel injection commencing time by adding the time length α to the present time. The CPU 42 then proceeds to step 209 to set the obtained fuel injection commencing time in a compare register. In step 210, the injection time length TAU is set in the register.

In step 211, the initiating timing CCRINJ is obtained from the following equation (4).

$$CCRINJ=\{(THINJEND-THINJ)/30\}-1 \quad (4)$$

In step 212, the CPU 42 judges whether the initiating timing CCRINJ is smaller than zero. If this condition is satisfied (CCRINJ<0), the CPU 42 proceeds to step 213 and adds "24" to the initiating timing CCRINJ. The CPU 42 stores the sum in the RAM 44 as a new initiating timing CCRINJ and then terminates the routine. If the above condition is not satisfied (CCRINJ≧0), the CPU 42 stores the value obtained in step 211 as the initiating timing CCRINJ in the RAM 44 and then ends the routine.

The routine shown in FIG. 6 is executed when reaching each fuel injection commencing time, which has been set in the compare register in step 209 of the routine shown in FIG. 4. In step 301 of this routine, the CPU 42 energizes the associated injector 29. In step 302, the CPU 42 adds the injection time length TAU, which is set in step 210, to the fuel injection commencing time and sets the sum as the fuel injection terminating time. In step 303, the CPU 42 sets the fuel injection terminating time in the compare register and then ends the routine.

The routine shown in FIG. 7 is executed when each fuel injection terminating time, which has been set in the compare register in step 303 of the routine shown in FIG. 6, is reached. In step 401, the CPU 42 de-energizes the injector 29 and then ends the routine.

When each of the above routines are executed, sequential injection is carried out as shown in FIG. 8. For example, if the value of the crank count CCRNK is "6" at timing t1 and matches the value of the initiating timing CCRINJ, which has been set in the previous cycle, the CPU 42 obtains the valve open time length angle THINJ of the injector 29 associated with the first cylinder, the valve closing angle THINJEND, the valve opening angle, the crankshaft change angle INJCA, the time length α, and the fuel injection commencing time. Then, the fuel injection time is set (step 209). Thus, the above processing corresponds to steps 201 to 209. The timing for starting processing of the fuel injection in the next cylinder (CCRNK=12) is obtained afterward (step 211).

Timing t2 corresponds to the fuel injection commencing time. The injector 29 is energized (step 301) and the fuel injection terminating time is set (step 303) at timing t2. At timing t3, which corresponds to the fuel injection terminating time, the injector 29 is de-energized (step 401) to terminate fuel injection.

In this manner, the amount of fuel that corresponds to the intake air amount for each cylinder is computed before the suction stroke is performed in the cylinder. After the computation, the obtained amount of fuel is injected from the injector 29 in accordance with the rotation of the crankshaft 17.

A routine executed by the CPU 42 for performing non-sequential injection will now be described with reference to the flowchart of FIG. 9. When non-sequential injection is performed, fuel is injected from the injector 29 in a manner unrelated to the crank angle so as to improve responsiveness immediately after acceleration.

When entering the routine, the CPU 42 first judges whether non-sequential injection is required in step 501. Non-sequential injection is required, for example, when the change in the throttle opening TA of the throttle sensor 36, which is detected by the throttle sensor 36, is greater than a predetermined value. In such state, the throttle valve 25 is opened widely within a short period of time to increase the intake air amount and accelerate the vehicle 10. If sequential injection is performed when the intake air amount increases suddenly, the supply of fuel becomes insufficient with respect to the intake air amount. This causes the air-fuel ratio to become lean. Non-sequential injection is performed to compensate for the increased amount of air.

When it is determined that non-sequential injection is not required in step 501, the CPU 42 ends the routine. If it is determined that non-sequential injection is required, the CPU 42 proceeds to step 502. In step 502, the CPU 42 judges whether the cylinder undergoing the suction stroke is receiving an increasing intake air flow rate. More particularly, the CPU 42 judges whether the present crank angle is smaller than a crank angle at which the intake air rate becomes constant (steady state angle β).

The steady state angle β is determined by factors such as the intake air amount (mass) during each rotation of the engine 11 or the engine speed NE. Accordingly, the steady state angle β for the current intake air rate and the engine speed NE may be obtained by referring to a map that indicates the relationship between the intake air rate, the engine speed NE, and the steady state angle β. The steady state angle β has a large value when the engine speed NE is low (e.g., the steady state angle β is 180° CA when the initiation of the suction stroke NE corresponds to 0° CA), and has a low value when the engine speed NE is high (e.g., the steady state angle β corresponding to 90° CA when the initiation of the suction stroke NE corresponds to 0° CA). In other words, when the engine speed NE is high, the intake air rate becomes constant at an early stage of the suction stroke.

When it is determined that the intake air rate is not yet steady, the CPU 42 determines that non-sequential injection is required, since the present intake air amount is still increasing and proceeds to step 504. If it is determined that the intake air amount is steady, the CPU 42 proceeds to step 503 and judges whether the cylinder that will subsequently undergo the suction stroke is ready to perform sequential injection. In other words, the CPU 42 judges whether the next cylinder is ready to perform computation of the fuel injection amount that is to be injected through sequential injection. The suction stroke in each cylinder is performed in the predetermined order of the first, third, fourth, and second cylinder. Thus, the cylinder that is to subsequently undergo the suction stroke may be determined by locating the cylinder that is presently undergoing the suction stroke. The CPU 42 confirms whether the fuel injection commencing time has been set in the compare register during step 209 of the routine shown in FIG. 4 to determine that the next cylinder is ready to perform sequential injection.

If it is determined that the next cylinder is not ready to perform sequential injection in step 503, the CPU 42 ends the routine. If the next cylinder is ready to perform sequential injection, the CPU 42 proceeds to step 504.

In step 504, the CPU 42 sets either the subject cylinder of step 503 or the subject cylinder of step 504 as the injection commencing cylinder. The injection commencing cylinder indicates the cylinder that is to undergo the earliest suction stroke among the cylinders in which non-sequential injection is to be performed.

In step 505, the CPU 42 sets the cylinder that has not yet undergone the suction stroke but is ready to perform sequential injection as the injection terminating cylinder. The injection terminating cylinder indicates the cylinder that is to undergo the latest suction stroke among the cylinders in which non-sequential injection is to be performed.

In step 506, the CPU 42 computes the injection time length TAU during which non-sequential injection is performed. The injection time length TAU is obtained in accordance with factors such as the present engine load and the coolant temperature THW. In step 507, the CPU 42 energizes the injector 29 of each cylinder included between the injection commencing cylinder set in step 504 and the injection terminating cylinder set in step 505 for a length of time that corresponds to the fuel injection time TAU. The CPU 42 then terminates the routine.

When the driver suddenly presses the acceleration pedal to accelerate the vehicle 10, the throttle valve 25 is opened widely and the passage area in the intake passage 28 is increased in a sudden manner. Thus, non-sequential injection is required in certain cylinders. In this state, the CPU 42 locates the cylinder that is presently undergoing the suction stroke. The CPU 42 then judges whether the intake air rate is subject to further change during the suction stroke (that is, whether the intake air rate is steady). If it is determined that the intake air amount has become constant, the CPU 42 prohibits non-sequential injection from being performed in the cylinder. These procedures are carried out as the CPU 42 executes steps 502, 503, 504 of the routine shown in FIG. 9 and sets the next cylinder that is to undergo the suction stroke as the injection commencing cylinder. If non-sequential injection is performed in cylinders for which the intake air rate is constant, the air-fuel ratio of the air-fuel mixture becomes rich due to excessive fuel that is supplied during the latter half of the suction stroke. However, the present invention prohibits non-sequential injection in cylinders that do not require non-sequential injection. This prevents the air-fuel ratio from becoming rich.

When performing non-sequential injection, excluding the cylinder undergoing the suction stroke, the cylinders for which the fuel injection amount has not yet been computed are located. Non-sequential injection is prohibited in the cylinders for which the fuel injection amount has not yet been computed. This procedure is carried out as the CPU 42 executes step 505 of the routine shown in FIG. 9 and sets the cylinder ready to perform sequential injection as the injection terminating cylinder. When the passage area of the intake air is increased suddenly during sequential injection, the fuel injection amount that corresponds to the increased amount of intake air is computed for the cylinders that are not undergoing the suction stroke and are also not ready for sequential injection. If non-sequential injection is performed in cylinders that are able to cope with the increase in the intake air amount when computing the increased amount of fuel injection, the air-fuel ratio of the air-fuel mixture becomes rich due to the excessively supplied fuel. However, the present invention prohibits non-sequential injection in cylinders that do not require non-sequential injection. This prevents the air-fuel ratio from becoming rich.

When there is a request for non-sequential injection, the routine illustrated in the flowchart of FIG. 9 is executed to perform non-sequential injection in the following manner. With reference to FIG. 8, at timing t5, the first cylinder is undergoing the suction stroke and the rate of intake air in the first cylinder is not yet steady. In this case, the injection commencing time of the third cylinder that is to perform the next suction stroke has already been set. When there is a request for non-sequential injection at timing t5, steps 501, 502, and 504 to 507 are executed. This sets the first cylinder as the injection commencing cylinder and sets the third cylinder as the injection terminating cylinder. Accordingly, non-sequential injection is performed simultaneously only in the first and third cylinders.

When the first cylinder is undergoing the suction stroke at timing t6, the flow rate of intake air in the first cylinder has already been found to be steady and the injection commencing time of the third cylinder has already been set. When there is a request for non-sequential injection at timing t6, steps 501 to 507 are executed one after another. This sets the third cylinder as the injection commencing cylinder and also as the injection terminating cylinder. Hence, non-simultaneous injection is performed solely in the third cylinder.

When the throttle valve 25 suddenly increases the passage area of the intake air passage 28 and thus causes a sudden increase in the amount of intake air, the amount of injected fuel must be increased to cope with the change in the amount of intake air. In the present invention, the cylinders that are capable of increasing the amount of fuel by continuing sequential injection are distinguished from the cylinders that require non-sequential injection to increase the rate of fuel. Non-sequential injection is performed to correct the insufficient amount of fuel in cylinders that are otherwise not capable of increasing the amount of fuel. Non-sequential injection is prohibited in cylinders that are capable of increasing fuel. This ensures responsiveness when the throttle valve 25 is suddenly opened widely during acceleration and thus improves performance. Additionally, the prohibition of non-sequential injection in certain cylinders prevents excessive supply of fuel. This suppresses undesirable emissions. Therefore, performance may be improved while also suppressing undesirable emissions.

Furthermore, when selecting the cylinders in which non-sequential injection is to be performed, the injection commencing cylinder, which is the cylinder that undergoes the earliest suction stroke, and the injection terminating cylinder, which is the cylinder that undergoes the latest suction stroke, are determined. Non-sequential injection is carried out simultaneously in the cylinders that undergo the suction stroke between the suction strokes of the injection commencing cylinder and the injection terminating cylinder. Accordingly, the requirement for non-sequential injection need not be determined for every cylinder. This enables efficient determination of the cylinders that require non-sequential injection.

Although only one embodiment of the present invention has been described herein, it should be apparent to those skilled in the art that the present invention may be embodied in many other specific forms without departing from the spirit or scope of the invention. In particular, the above embodiment may be modified as described below.

The steady state angle β obtained in step 502 of the routine illustrated in FIG. 9 is obtained by referring to a map. However, the steady state angle β may be obtained through a computation.

In the case that the number of cylinders, in which non-sequential injection is performed, is always the same, step 505 may be carried out by adding a predetermined number to the injection commencing cylinder to obtain the injection terminating cylinder.

The amount of fuel injected into the selected cylinders during non-sequential injection may be constant.

In the above embodiment, non-sequential injection is prohibited in cylinders that undergo the suction stroke before the injection commencing cylinder and in cylinders that undergo the suction stroke after the injection terminating cylinder. However, prohibition of non-sequential injection may be determined by using only one of these conditions.

In other words, the cylinder undergoing the suction stroke during sudden increase in the intake air passage area may be located while judging whether the present flow rate of intake air is still increasing. If the flow rate of intake air has become stable, non-sequential injection is prohibited in the located cylinder that is undergoing the suction stroke. This is equivalent to prohibiting non-sequential injection in cylinders that undergo the suction stroke before the injection commencing cylinder.

On the other hand, among the cylinders excluding the one undergoing the suction stroke during a sudden increase in the intake air passage area, the cylinders in which the amount of injected fuel has not yet been computed may be located. This is equivalent to prohibiting non-sequential injection in cylinders that undergo the suction stroke after the injection terminating cylinder.

Therefore, the present examples and embodiments are to be considered as illustrative and not restrictive and the invention is not to be limited to the details given herein, but may be modified within the scope of the appended claims.

What is claimed is:

1. A method for controlling fuel injection in an engine having a plurality of cylinders respectively accommodating a piston that reciprocates in accordance with rotation of a crankshaft, wherein each piston performs a suction stroke in accordance with the position of the crankshaft, an intake passage for drawing air into the cylinders, a throttle valve for adjusting a passage area of the intake passage, a fuel injection valve provided in association with each of the cylinders to inject fuel for the associated cylinder, said method comprising steps of:

determining necessity of non-sequential injection for the engine;

selecting the cylinder that needs to perform the non-sequential injection; and actuating the selected cylinder to perform the non-sequential injection.

2. The method as set forth in claim 1, wherein an electric control unit determines the necessity of the non-sequential injection when said throttle valve may suddenly increase the passage area during engine acceleration.

3. The method as set forth in claim 2, wherein said electric control unit selects and actuates at least one cylinder that needs to perform the non-sequential injection and prohibits at least one non-selected cylinder from performing the non-sequential injection.

4. The method as set forth in claim 3, wherein said electric control unit actuates the non-selected cylinder to perform the sequential injection.

5. The method as set forth in claim 1, wherein the fuel injection amount for each cylinder is computed and wherein said selecting step includes steps of:

specifying at least one cylinder undergoing the suction stroke; and excluding the specified cylinder for which the fuel injection amount has not been computed from the selection.

6. A method for controlling fuel injection in an engine having a plurality of cylinders respectively accommodating a piston that reciprocates in accordance with rotation of a crankshaft, wherein each piston performs a suction stroke in accordance with the position of the crankshaft, an intake passage for drawing air into the cylinders, a throttle valve for adjusting a passage area of the intake passage, wherein the throttle valve may suddenly increase the passage area during engine acceleration, a fuel injection valve provided in association with each of the cylinders to inject fuel for the associated cylinder, said method comprising:

performing sequential injection by injecting fuel in accordance with the position of the crankshaft; and performing non-sequential injection in a manner unrelated to the position of the crankshaft in addition to sequential injection when the throttle valve suddenly increases the passage area of the intake passage, which increases the intake air flow rate, so as to compensate for the increased intake air flow rate;

determining increase of the present flow rate of intake air for a selected cylinder; and prohibiting non-sequential injection when it is determined that the flow rate of intake air for the selected cylinder will not further increase.

7. The method as set forth in claim 6, further including the steps of:

computing a fuel injection amount for each cylinder corresponding to the flow rate of intake air for each cylinder before its suction stroke is performed; and using the computed fuel amount as the injected amount during the sequential fuel injection.

8. The method as set forth in claim 7, further including the steps of:

locating the cylinder undergoing its suction stroke when the passage area is suddenly increased; and using the located cylinder as the selected cylinder.

9. The method as set forth in claim 6, further including the steps of:

locating the cylinder undergoing its suction stroke when the passage area is suddenly increased; and using the located cylinder as the selected cylinder.

10. A method for controlling fuel injection in an engine having a plurality of cylinders respectively accommodating a piston that reciprocates in accordance with rotation of a crankshaft, wherein each piston performs a suction stroke in accordance with the position of the crankshaft, an intake passage for drawing air into the cylinders, a throttle valve for adjusting a passage area of the intake passage, wherein the throttle valve may suddenly increase the passage area during engine acceleration, a fuel injection valve provided in association with each of the cylinders to inject fuel for the associated cylinder, said method comprising:

computing a fuel injection amount for each cylinder corresponding to a flow rate of intake air for each cylinder before the suction stroke is performed;

performing sequential injection by injecting the computed fuel injection amount in accordance with the position of the crankshaft; and performing non-sequential injection in a manner unrelated to the position of the crankshaft in addition to sequential injection when the throttle valve suddenly increases the passage area of the intake passage, which increases the flow rate of intake air, so as to compensate for the increased flow rate of intake air;

locating the cylinder undergoing its suction stroke when the passage area is suddenly increased;

determining whether the present flow rate of intake air for the located cylinder will increase; and prohibiting non-sequential injection when it is determined that the flow rate of intake air for the located cylinder will not further increase.

11. A method for controlling fuel injection in an engine having a plurality of cylinders respectively accommodating a piston that reciprocates in accordance with rotation of a crankshaft, wherein each piston performs a suction stroke in accordance with the position of the crankshaft, an intake passage for drawing air into the cylinders, a throttle valve for adjusting a passage area of the intake passage, wherein the throttle valve may suddenly increase the passage area during engine acceleration, a fuel injection valve provided in association with each of the cylinders to inject fuel for the associated cylinder, said method comprising:

computing a fuel injection amount for each cylinder corresponding to a flow rate of intake air for each cylinder before the suction stroke is performed;

performing sequential injection by injecting the computed fuel injection amount in accordance with the position of the crankshaft; and performing non-sequential injection in a manner unrelated to the position of the crankshaft in addition to sequential injection when the throttle valve suddenly increases the passage area of the intake passage, which increases the flow rate of intake air, so as to compensate for the increased flow rate of intake air;

locating the cylinders, excluding a cylinder undergoing the suction stroke, in which the fuel injection amount has not yet been computed when the passage area is suddenly increased; and prohibiting non-sequential injection in the located cylinders.

12. A fuel injection control method for an engine, the engine having a plurality of cylinders respectively accommodating a piston that reciprocates in accordance with rotation of a crankshaft, an intake passage for drawing air into the cylinders, a throttle valve for adjusting a passage area of the intake passage, wherein the throttle valve may suddenly increase the passage area during engine acceleration, a fuel injection valve provided in association with each of the cylinders to inject fuel for the associated cylinder, wherein each piston performs a suction stroke in accordance with the position of the crankshaft, said method comprising:

computing a fuel injection amount for each cylinder corresponding to a flow rate of intake air for each cylinder before the suction stroke is performed;

performing sequential injection by injecting the computed fuel injection amount in accordance with the position of the crankshaft; and performing non-sequential injection in a manner unrelated to the position of the crankshaft in addition to sequential injection when the throttle valve suddenly increases the passage area of the intake passage, which increases the intake air rate, so as to compensate for the increased flow rate of intake air;

prohibiting non-sequential injection in a cylinder undergoing the suction stroke if the flow rate of intake air is steady when the passage area is suddenly increased; and prohibiting non-sequential injection in cylinders, excluding one undergoing its suction stroke, for which the fuel injection amount in the cylinders has not yet been computed when the passage area is suddenly increased.

* * * * *